US005934175A

United States Patent [19]

Vatel

[11] Patent Number: 5,934,175

[45] Date of Patent: Aug. 10, 1999

[54] CYLINDRICAL WORKING MEMBER AND SYSTEM EMPLOYING SAME

[76] Inventor: Bronislav Vatel, 2466 E. Oakton St., Arlington Heights, Ill. 60005

[21] Appl. No.: 09/016,356

[22] Filed: Jan. 30, 1998

[51] Int. Cl.[6] ..... F01D 9/00

[52] U.S. Cl. ..... 92/252; 92/253; 277/435

[58] Field of Search ..... 91/167 R; 92/248, 92/249, 200, 201, 252, 253; 277/435, 616, 619

[56] References Cited

U.S. PATENT DOCUMENTS

| | | | |
|---|---|---|---|
| 2,596,471 | 5/1952 | Densmore et al. | 91/167 R |
| 2,764,131 | 9/1956 | Knights | 91/167 R |
| 2,854,958 | 10/1958 | Wood et al. . | |
| 3,171,334 | 3/1965 | Rasmussen | 92/253 X |
| 4,516,468 | 5/1985 | Sheriff | 92/52 X |
| 5,072,811 | 12/1991 | Everhard | 92/51 X |

*Primary Examiner*—Hoang Nguyen
*Attorney, Agent, or Firm*—H. Jay Spiegel

[57] ABSTRACT

An improved cylindrical working member and associated system comprising a simple cylindrical sleeve having an outer surface with two spaced grooves surrounding a cylindrical land. At the other end, a single groove is formed. A "SANDWICH" consisting of a simple O-ring, a single back-up ring, a low snap ring is installed in each groove. An additional low friction snap ring forms a limit stop front cap. A plurality of the cylindrical sleeves can be employed to form a telescoping cylinder system. An additional embodiment using a guide member consisting of a plurality of square tubes of sequentially increasing cross-section formed into a non-rotating telescoping guide member to attach one end to the telescoping system, and other end to a plug of the hollow central rod. A simple system is used for extending and retracting the telescoping cylinder.

31 Claims, 6 Drawing Sheets

CYLINDRICAL WORKING MEMBER AND SYSTEM EMPLOYING SAME

BACKGROUND OF THE INVENTION

The present invention relates to an improved cylindrical working member and system employing same. In the prior art, it is known to employ a cylinder as a working member. However, in cylindrical working members known to Applicant, complicated machining steps are employed in manufacturing the working member. These machining steps add significant cost. As such, a need has developed for a working member that can be manufactured simply and cheaply and that will have the versatility to be used individually, in a telescoping cylinder system, and in other environments of use.

The following prior art is known to Applicant:

U.S. Pat. No. 2,308,761 to Komph, Sr.

U.S. Pat. No. 2,657,960 to Latimer-Needham

U.S. Pat. No. 2,854,958 to Wood et al.

U.S. Pat. No. 3,115,071 to Strader

U.S. Pat. No. 3,312,150 to Strader

U.S. Pat. No. 3,452,647 to Herrell

U.S. Pat. No. 3,631,765 to Neumeister

U.S. Pat. No. 3,934,423 to Haller

U.S. Pat. No. 4,195,714 to Massing

U.S. Pat. No. 4,516,468 to Sheriff

U.S. Pat. No. 4,541,325 to Sheriff

U.S. Pat. No. 4,691,617 to Purkott

U.S. Pat. No. 4,926,745 to Cioletti.

Of the references listed above, Komph, Sr., Wood et al., Herrell, Neumeister, Haller, Massing, Sheriff '468, Sheriff '325, and Purkott teach telescoping cylinder systems in which a plurality of individual cylinders are assembled together to allow telescoping. In each of these references, complicated machining steps are employed in the manufacturing process, including manufacturing of a multiplicity of grooves, creation of integral shoulders, and the like. The present invention differs from the teachings of these references as contemplating making such a cylinder of a stock cylindrical tube with a minimal number of grooves machined therein and the use of low friction snap rings and seals to contain fluid pressure.

Latimer-Needham teaches a piston having a complicated structure including an integral shoulder designed to contain seal rings. No such integral shoulders are required in the present invention.

Strader '071 and '150 teach a reciprocating hydraulic motor employing a sleeve mounted on a post and having a plurality of seals and rings mounted on the periphery thereof. Strader '071 and '150 require the machining of a deep groove in the sleeve with seals and rings mounted to each side thereof. Such structure is unnecessary in the present invention.

Cioletti teaches a pull rod assembly wherein a rod has several grooves machined in the outer periphery thereof and a complicated seal mechanism is mounted thereon and retained in place for the use of a split retainer ring and a "TRUE ARC" ring. While Cioletti teaches an improvement over the prior art, the present invention relates to a cylinder, not a rod, and contemplates a simple seal system merely employing simple O-rings and low friction snap rings to retain them in place.

Applicant's prior U.S. Pat. No. 5,341,724 discloses a pneumatic telescoping cylinder and method wherein each of the stages of the telescoping cylinder system employs somewhat complicated machining steps and seal members having complicated shapes. The teachings of the present invention may be employed to simplify the system described in Applicant's prior Patent and the actuating system disclosed herein may also be employed in actuating the telescoping cylinder of Applicant's prior Patent.

SUMMARY OF THE INVENTION

The present invention relates to an improved cylindrical working member and system employing same. The present invention includes the following interrelated objects, aspects and features:

(1) In a first aspect, each of the working members contemplated in accordance with the teachings of the present invention employs a simple cylindrical sleeve such as an aluminum sleeve easily purchased at any supply store. At one end of the sleeve, the outer surface has machined therein two spaced grooves leaving a cylindrical land therebetween formed by the original structure of the sleeve.

(2) At the other end of this off-the-shelf sleeve, a single groove is formed within the passageway through the sleeve.

(3) A "SANDWICH" consisting of a simple O-ring surrounded on either side by a single back-up ring is slid over the outer surface of the sleeve and onto the "land" between the two outer grooves. A snap ring is installed in each groove to lock the position of the O-ring-back-up rings "SANDWICH" in position overlying the land, thereby creating a working member. An additional snap ring is inserted within the groove within the passageway and forms a limit stop for a purpose to be described in greater detail hereinafter.

(4) The working member described in detail in paragraphs (1)–(3) above may be employed in a telescoping cylinder system. In this regard, a plurality of off-the-shelf cylindrical sleeves of sequentially increasing diameter may be formed into working members in the manner described above. An additional small semi-circular cross-section groove may be formed in the outer surface of each sleeve concentrically outside the groove formed within the passageway thereof and a simple O-ring may be mounted therein, as will be described in greater detail hereinafter, to engage the inner snap ring of the next outer sleeve in the telescoping arrangement to preclude collapsing of a telescoping cylinder system.

(5) In such a telescoping cylinder system, the proximal end of the cylinders is located adjacent the above-described lands. For this purpose, a cap is mounted over the outer surfaces of the outermost sleeve to enclose the system. The distal ends of the sleeves are located where the inner grooves have been machined and a central rod is formed by plugging the central opening of the innermost sleeve to seal the system.

(6) A non-rotating rod system may be employed within the telescoping cylinder system described in detail in paragraphs (1)–(5). For this purpose, a plurality of off-the-shelf square tubes of sequentially increasing cross-section may be formed into a telescoping non-rotating working member which may fit inside of the hollow rod. A proximal end of the largest square tube is mechanically attached to a rear cap, and a distal end of the smallest square tube is mechanically attached to a plug of the hollow rod. The working member reciprocates simultaneously with the telescoping cylinder and prevents rod rotation relative to the rear cap and outermost sleeve.

(7) Applicant has devised a simple system for extending and retracting a telescoping cylinder system in accordance with the teachings of the present invention. In the inventive system, a single port is provided within the cap at the proximal ends of the respective sleeves. This port is fluidly connected to the throat of a venturi that has an inlet connected to a source of compressed air and an outlet connected to a simple on-off valve. As should be understood by those skilled in the art, when the valve is open, air flows freely through the venturi inducing a vacuum at the throat that evacuates the interior of the telescoping cylinder system maintaining it in the retracted configuration. When the valve is closed, air cannot escape through the outlet in the venturi and, thus, travels out the throat and into the telescoping cylinder chamber extending same. When it is desired to thereafter collapse the telescoping cylinder, the valve is opened inducing vacuum at the throat of the venturi to evacuate the telescoping cylinder chamber and thereby positively retract the telescoping cylinder.

Accordingly, it is a first object of the present invention to provide an improved cylindrical working member and system employing same.

It is a further object of the present invention to provide such a system wherein a simple working member is created out of a simple cylindrical sleeve with a few grooves formed therein and simple O-rings and snap rings being employed.

It is a still further object of the present invention to provide such a system wherein a telescoping cylinder system may be easily made out of a plurality of simple cylindrical working members manufactured in accordance with the teachings of the present invention.

It is a still further object of the present invention to provide such a system wherein an actuating means employs a simple venturi and an on-off valve.

It is a still further object of the present invention to provide such a system wherein a central rod is non-rotatable relative to a rear cap and outermost sleeve thereof.

These and other objects, aspects and features of the present invention will be better understood by those skilled in the art when read in conjunction with the appended drawing figures.

SPECIFIC DESCRIPTION OF THE PREFERRED EMBODIMENTS

With reference to FIGS. 1–4, a first embodiment of a cylindrical working member made in accordance with the teachings of the present invention is described in detail.

Figure 1:
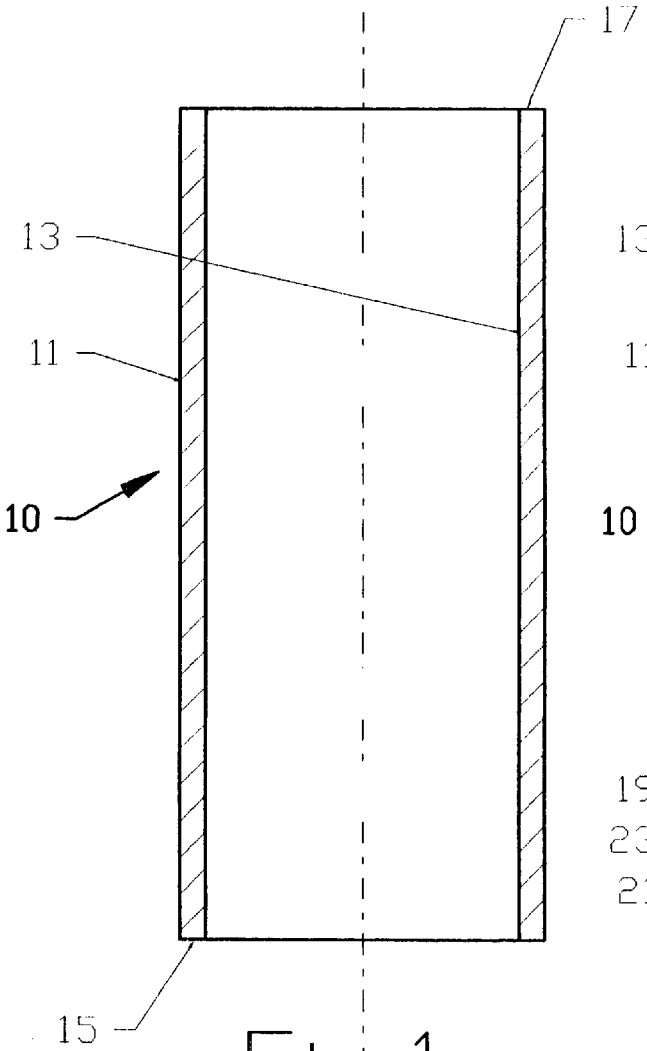
FIG. 1 shows a cross-sectional view through a simple cylindrical tube.

As seen in FIG. 1, a cylindrical sleeve 10 includes a smooth cylindrical outer surface 11, a cylindrical passageway 13 therethrough, and a first end 15 as well as a second end 17.

Figure 2:
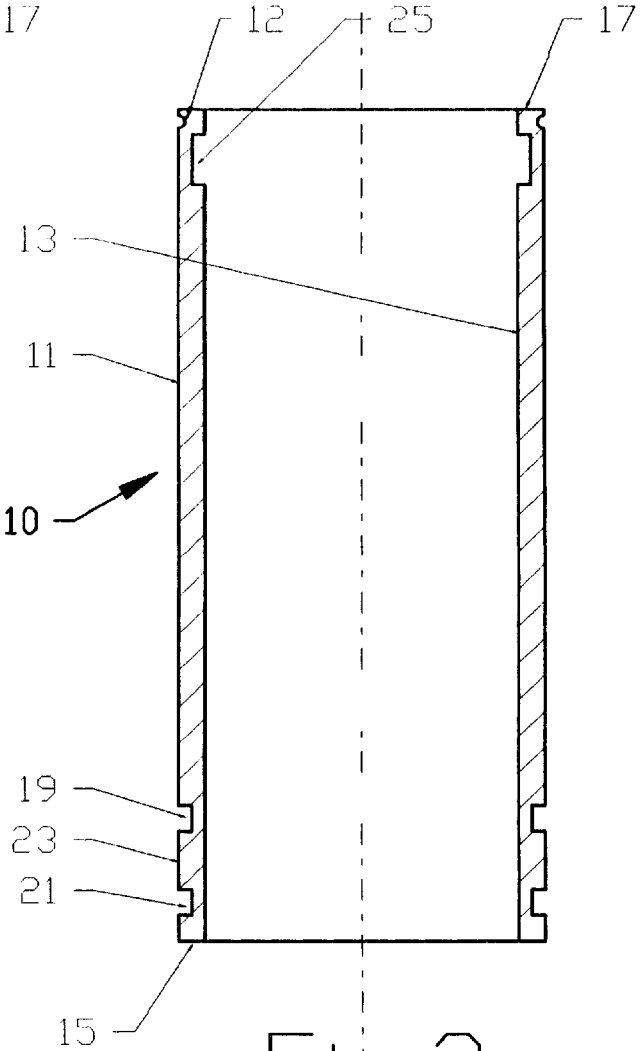
FIG. 2 shows the tube of FIG. 1 with certain grooves machined therein.

With reference to FIG. 2, spaced grooves 19 and 21 are machined in the smooth outer surface 11 of the sleeve 10 to create a land 23 for a purpose to be described in greater detail hereinafter. Further, a groove 12 is machined on the other end of the same surface. Additionally, a groove 25 is machined radially outwardly in the passageway 13.

Figure 4:
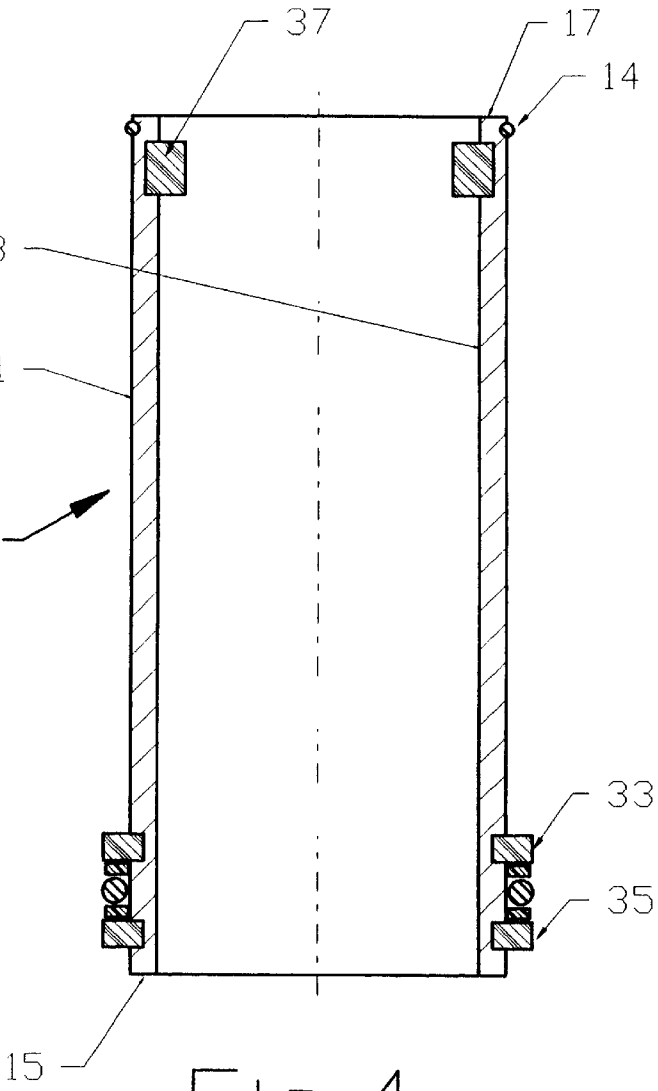
FIGS. 3 and 4 show the process of assembling simple O-rings, back-up rings, and snap rings to form a simple cylindrical working member.
Figure 3:
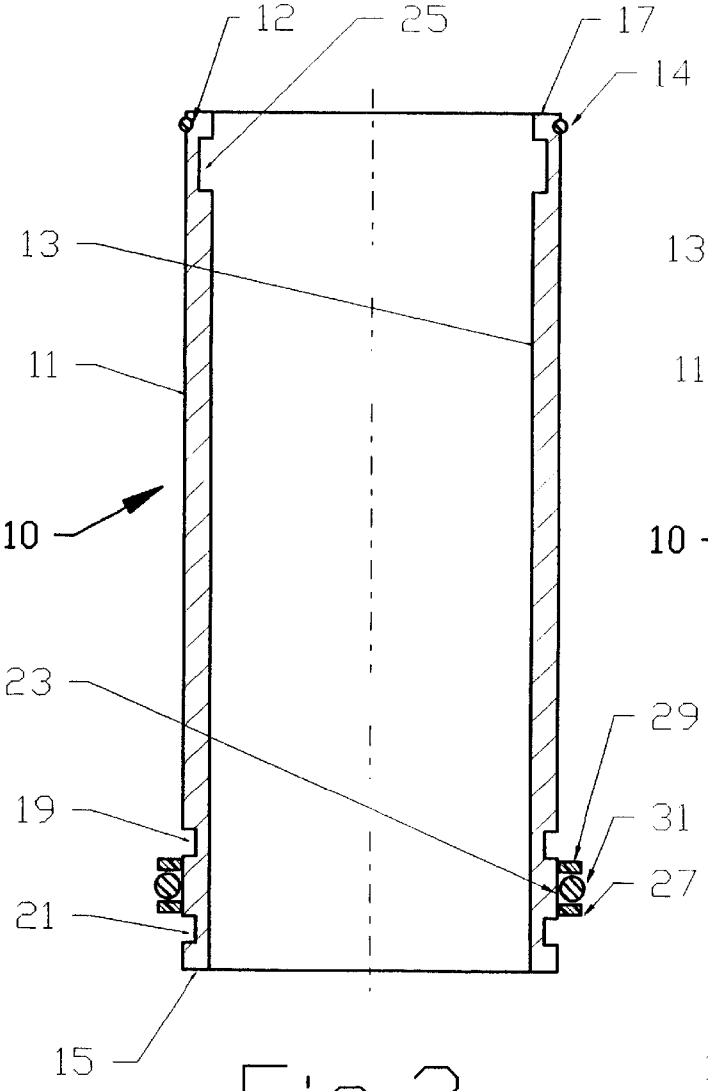

As seen in FIG. 3, a "SANDWICH" consisting of two back-up rings 27 and 29 longitudinally surrounding a simple O-ring 31 is placed over the outer surface 11 of the sleeve 10 and overlies the land 23. Additionally, a single O-ring 14 is assembled into groove 12. As seen in FIG. 4, low friction snap rings 33 and 35 are mounted in the respective grooves 19 and 21 to retain the "SANDWICH" in overlying relation to the land 23. Additionally, a snap ring 37 is assembled into the groove 25. The assembly illustrated in FIG. 4 comprises a simple working member.

Figure 5:
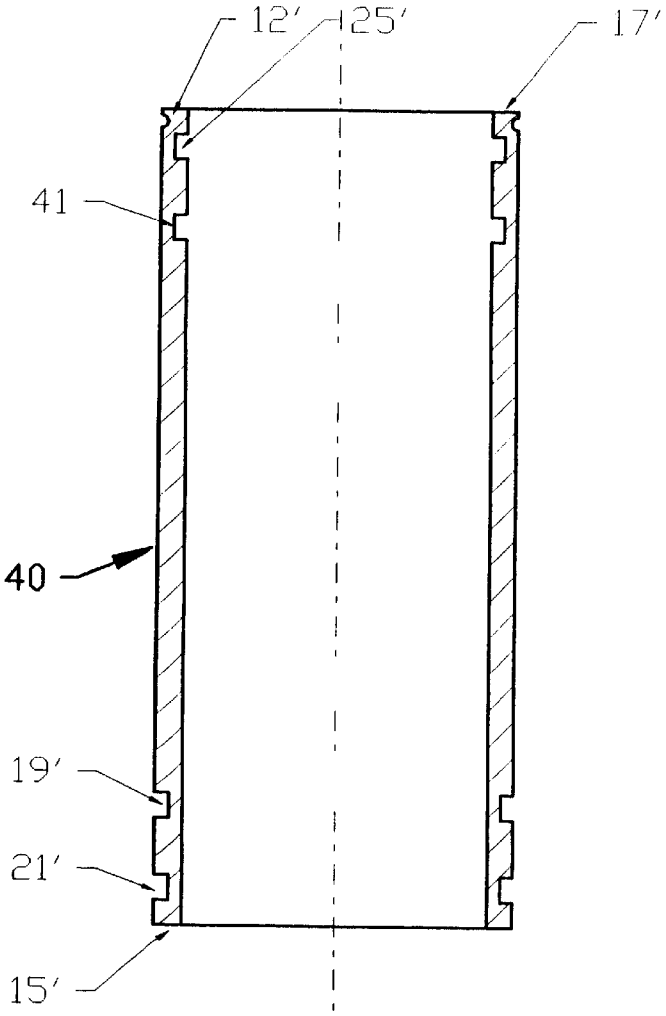
FIG. 5 shows an alternative pattern of grooves to be machined in the sleeve.

With reference to FIG. 5, a second embodiment of working member is generally designated by the reference numeral 40 and like elements from the embodiment of FIGS. 1–4 are referred to using like primed reference numerals. The sole difference between the sleeve 40 of FIG. 5 and the sleeve 10 as illustrated in FIG. 2 consists of the provision of an additional groove 41 machined radially outwardly into the passageway 13' through the sleeve 40.

Figure 6:
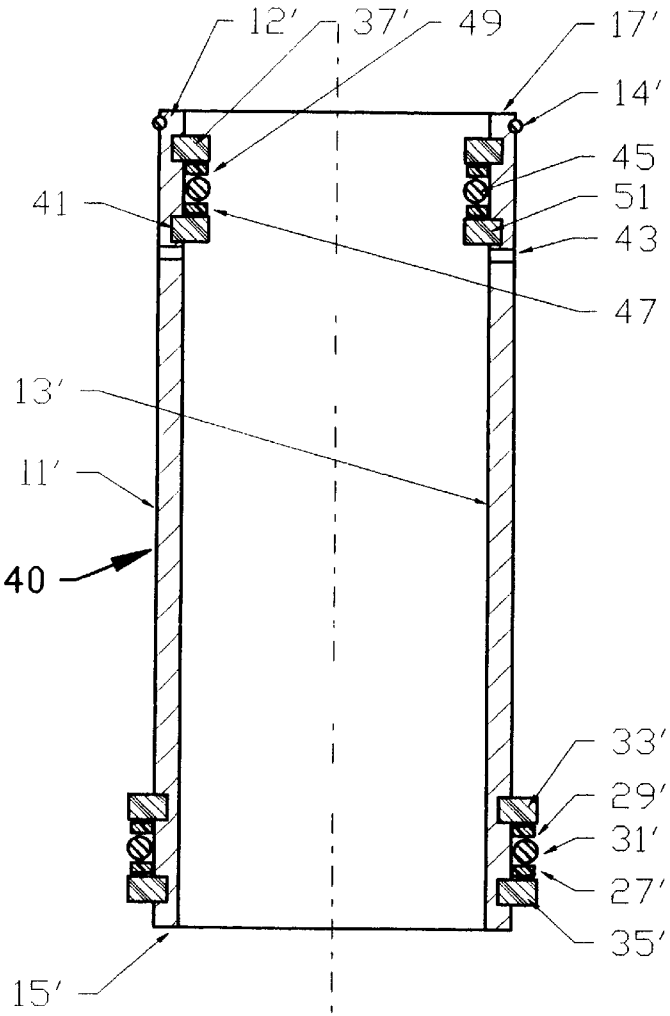
FIG. 6 shows snap rings, O-rings, and back-up rings assembled to the sleeve of FIG. 5.

With reference to FIG. 6, additionally, a plurality of circumferentially spaced radial holes 43 are machined through the wall of the sleeve 40. A "SANDWICH" including a simple O-ring 45 surrounded by back-up rings 47 and 49 is inserted into the passageway 13' and engages the passageway walls and is held in place through the provision of the low friction snap ring 37' and an additional low friction snap ring 51 that is adjacent the passageways 43.

Figure 7:
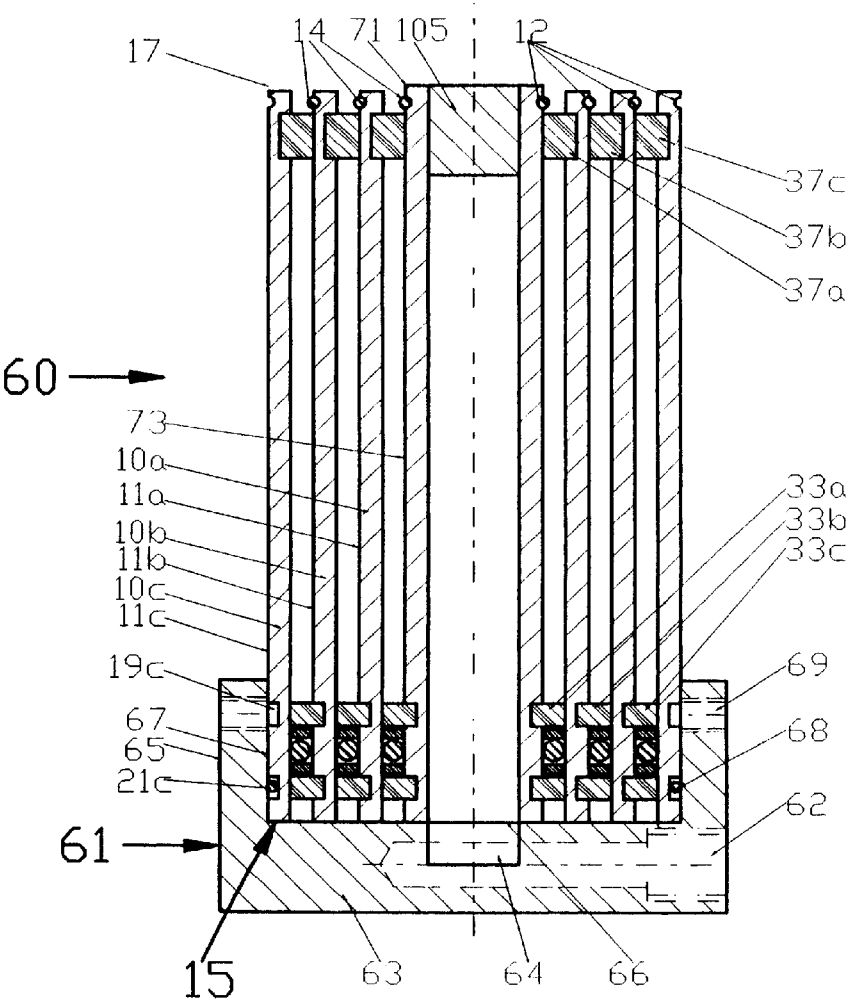
FIG. 7 shows a cross-sectional view through a telescoping cylinder system employing sleeves such as those illustrated in FIGS. 1–4.

With reference to FIG. 7, a telescoping cylinder system 60 may be formed out of a multiplicity of working members such as that which is described in connection with FIGS. 1–4 above. As is seen in FIG. 7, cylindrical sleeves 10*a*, 10*b* and 10*c* have increasing diameter and have proximal ends 15 as well as distal ends 17 corresponding to the same ends as described with reference to FIGS. 1–4. A cap 61 includes an end portion 63 and cylindrical or rectangular side walls 65 having an inner cylindrical surface 67 sized to slide over the outer surface 11*c* of the sleeve 10*c* and is retained in place through the use of a plurality of circumferentially spaced set screws 69 received in the annular groove 19*c* formed in the outer surface 11*c* of the sleeve 10*c*. O-ring 68 in the groove 21*c* of the sleeve 10*c* prevents fluid leakage.

The outer surfaces 11*a* and 11*b* of the respective sleeves 10*a* and 10*b* and outer surface 73 of rod 71 have grooves 12 formed therein which receive O-rings 14 which prevent accidental collapsing of stages through interengagement with snap rings 37*a*, 37*b* and 37*c*, respectively. The snap ring 37*a* mounted on the cylinder 10*a* has a smaller diameter than the respective diameters of the snap rings 37*b* and 37*c* and has an inner surface engaging the outer surface 73 of a piston rod 71. A plug 105 seals the passageway through the sleeve forming the rod 71.

The cap 61 includes a fluid port 62 radially extending therethrough and connecting with an axially directed port 64 connected into the chamber 66 and exposed to the working surfaces of the sleeves, snap rings and O-rings. As should be understood, when air pressure is applied to the port 62, pressurized air flows through the port 62 and the port 64 and pressurizes the chamber 66 and causes all working members to reciprocate upwardly in the view of FIG. 7. When the snap ring 33*a* engages the snap ring 37*a* on the sleeve 10*a*, and the snap ring 33*b* engages the snap ring 37*b* on the sleeve 10*b*, and the snap ring 33*c* engages the snap ring 37*c* on the sleeve 10*c*, the system 60 is fully extended.

When air pressure is no longer applied to the port 62, the system may collapse through application of an external force. If it is desired to enhance the speed of collapsing of the system 60, or double-acting actuation is required, a source of vacuum may be applied to the port 62 as will be described in greater detail hereinafter.

Figure 8:
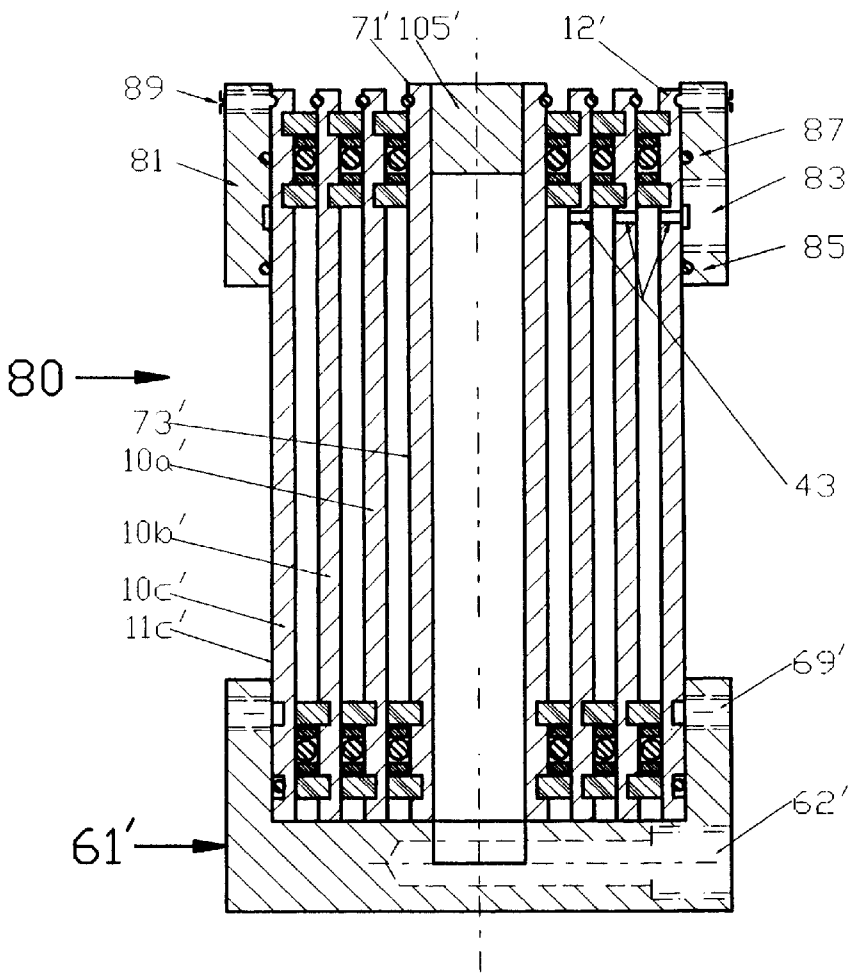
FIG. 8 shows a modification of the telescoping cylinder system shown in FIG. 7 and comprising an improvement over Applicant's prior U.S. Pat. No. 5,341,724.

With reference to FIG. 8, a system 80 is shown which employs a plurality of cylindrical working members such as those illustrated with reference to FIGS. 5 and 6. The portions of the structure of the system 80 illustrated in FIG. 8 to the bottom of the figure correspond to the corresponding structures illustrated in FIG. 7. At the distal end of the sleeve 10*c*', an outer sleeve 81 is mounted that has a port 83 therethrough that fluidly communicates with the passageways 43 through the sleeves 10*a*', 10*b*' and 10*c*'. O-rings 85 and 87 axially surround the port 83 to prevent leakage. Circumferentially spaced set screws 89 received in the circumferential groove 12*c* in the outer surface 11*c*' of the sleeve 10*c*' retain the sleeve 81 thereon. A plug 105' seals the passageway through the sleeve forming the rod 71'.

As should be understood from Applicant's prior U.S. Pat. No. 5,341,724 and the structure shown and described with reference to FIG. 8 herein, the port 83 may be connected to a source of air pressure which may be applied when it is desired to collapse the telescoping cylinder system 80 after it has been extended through application of air pressure at the port 62'.

Figure 10:
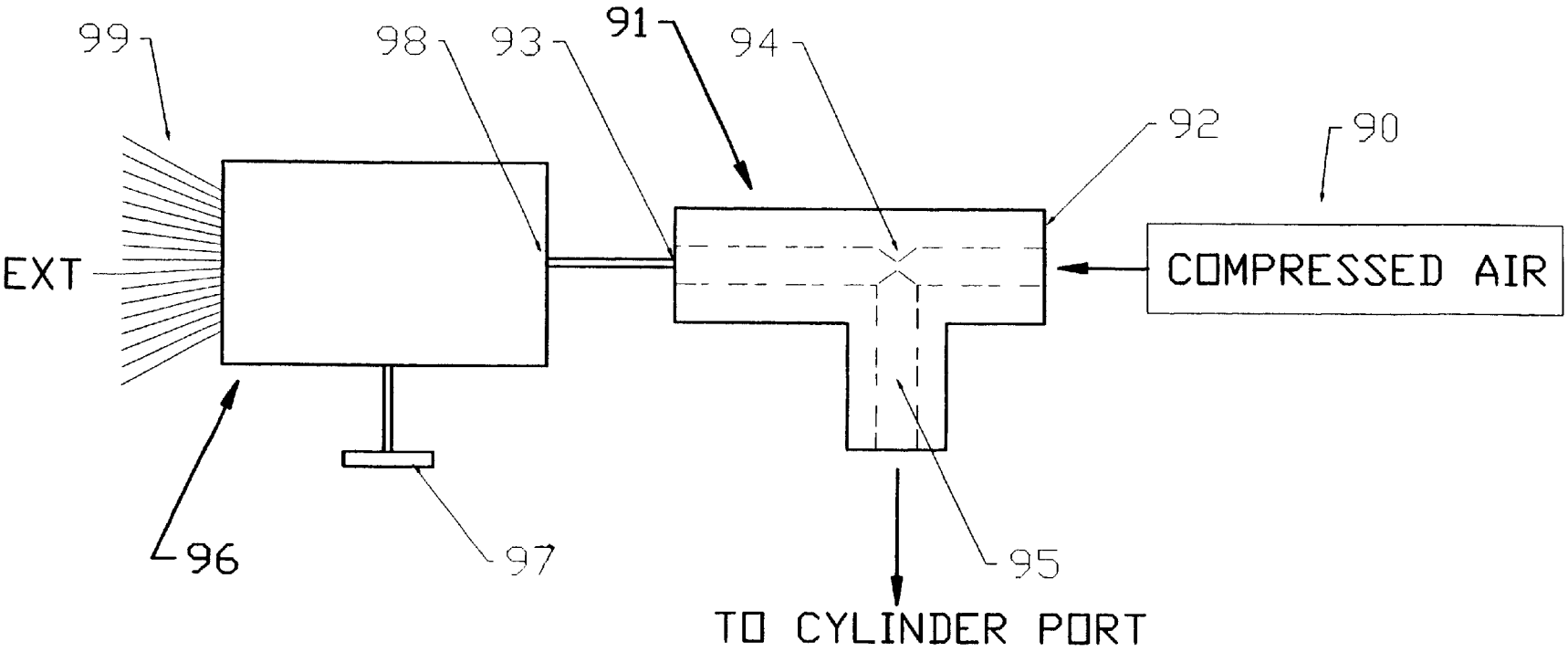
FIG. 10 shows a schematic representation of an actuating system for the telescoping cylinders of the present invention.

Reference is now made to FIG. 10 which describes an actuating system that may be employed with the telescoping cylinder system illustrated in FIG. 7. In particular, the actuating system of FIG. 10 includes a source 90 of compressed air that may be applied under pressure at the inlet 92 of a venturi 91 also having an outlet 93, a throat 94, and a side passageway 95 fluidly connected to the throat 94. The outlet 93 of the venturi 91 is fluidly connected to an on-off valve 96 having an actuator 97 that may be a solenoid actuator, a pneumatic actuator, or a manual actuator as desired. The valve 96 includes an inlet port 98 and an outlet port 99 as well as a valve head of any suitable type (not shown). The passageway 95 is connected to the port 62 of the system 60.

As should be understood, when the valve 96 is open, compressed air freely flows through the inlet 92 and outlet 93 of the venturi 91. This flow of fluid creates a vacuum at the throat 94 which sucks air from the port 62 of the system 60 through the passageway 95 of the venturi 91 through the throat 94 and out the outlet 93 thereof.

When the valve 96 is closed, flow of air out the outlet 93 of the venturi 91 is prevented thereby forcing compressed air in the throat 94 to flow through the passageway 95 in the direction of the port 62.

As should now be understood, when the valve 96 is closed, positive air pressure is seen at the port 62 and the system 60 may expand, telescoping upwardly as should be understood from the above description. When it is desired to collapse the system 60, the valve 96 is merely opened causing a vacuum to be induced at the throat 94 thereby causing a suction force applied at the port 62 which tends to evacuate the chamber 66 to cause collapsing of the system 60. In this way, a simple system is provided to supply and exhaust the chamber 66 of the system 60.

Figure 9:
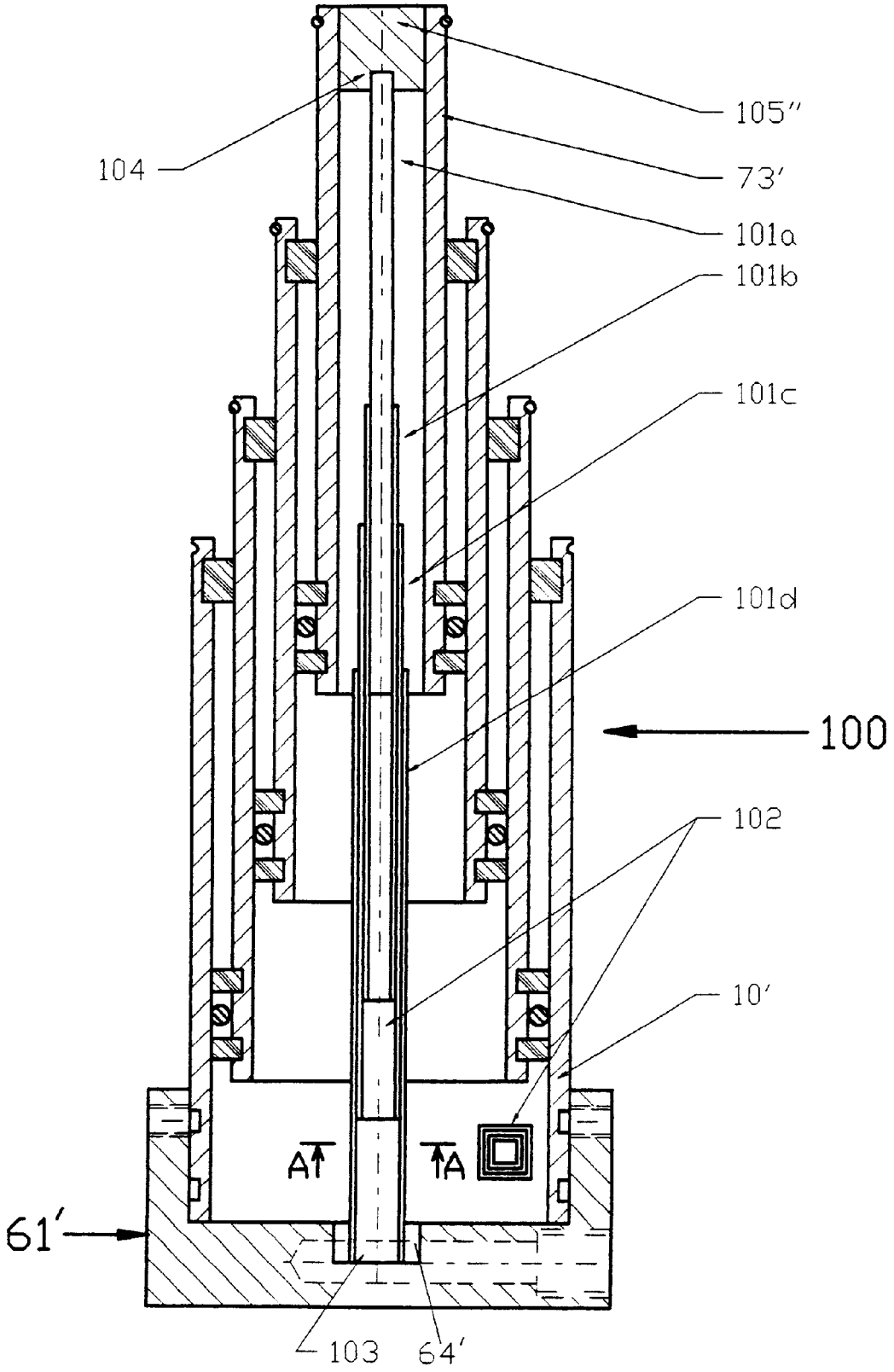
FIG. 9 shows a cross-sectional view through a telescoping working member system employing square tubes to prevent radial rotation of the central rod with respect to the rear cap and outer sleeve.

With reference to FIG. 9, a system 100 is shown which employs a plurality of square tubes 101*a*, 101*b*, 101*c*, 101*d* of sequentially increasing sizes assembled into a telescoping non-rotating guide member 102. The proximal end 103 of the tube 101*d* is mechanically attached to the port 64' of the cap 61'. The distal end 104 of the tube 101*a* is mechanically attached to a plug 105". Non-rotating guide member 102 extends and retracts simultaneously with the telescoping cylinder, but the plug 105" of the rod 73' always has the same rotative orientation with respect to the cap 61' and the sleeve 10'.

In the embodiments of the present invention, the O-rings that are employed are simple O-rings having circular cross-sections. While O-rings of other cross-sections may suitably be employed, circular cross-section O-rings are the simplest type and the present invention in its embodiments is designed to allow effective operation using such simple O-rings. The O-rings may be made of a suitable rubber or plastic compound such as polytetrafluoroethylene sold under the Trademark "TEFLON". The split rings such as those designated by the reference numerals 33, 35, 37 and 51 may be of quite simple construction preferably made of square or rectangular cross-section. In accordance with the teachings of the present invention, these snap rings may be made of low friction metal such as iron or bronze or, if desired, of low friction plastic such as those sold under the Trademarks "TEFLON" or "DELRIN". The back-up rings, such as those designated by the reference numerals 27 and 29, are preferably made of a suitable metal or plastic such as, for example, polytetrafluoroethylene.

As such, an invention has been described in terms of preferred embodiments thereof which fulfill each and every one of the objects of the invention as set forth hereinabove and provide a new and useful improved cylindrical working member and system employing same of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A working member comprising:

a) a sleeve having outer and inner surfaces, said sleeve having a first end and a second end;

b) said outer surface having two closely spaced grooves adjacent said first end defining therebetween a land comprising a portion of said outer surface; and c) an O-ring on said land retained thereon by low friction guiding snap rings received in each of said grooves.

2. The working member of claim 1, further including two back-up rings, one of said back-up rings being located on each lateral side of said O-ring and captured on said land by said snap rings.

3. The working member of claim 1, said spaced grooves comprising first and second grooves, said snap rings comprising first and second snap rings, and further including a third groove in said inner surface adjacent said second end and a third low friction snap ring received in said third groove.

4. The working member of claim 2, said spaced grooves comprising first and second grooves, said snap rings comprising first and second snap rings, and further including a third groove in said inner surface adjacent said second end and a third low friction snap ring received in said third groove.

5. The working member of claim 3, further including a fourth groove closely spaced from said third groove and defining a further land, and a further O-ring having a radially outward surface engaging said further land, said further O-ring being captured on said further land by said third snap ring and a fourth low friction snap ring received in said fourth groove.

6. The working member of claim 5, further including back-up rings to either side of said further O-ring captured by said third and fourth snap rings.

7. The working member of claim 6, further including a passageway extending radially through said sleeve adjacent said fourth groove.

8. The working member of claim 7, wherein said passageway is located between said fourth groove and said first end.

9. A telescoping working member including a plurality of cylindrical sleeves according to claim 3, including a first sleeve having a first diameter and a second sleeve having a second larger diameter, a cap surrounding a first end of said second sleeve and having a port connectable to a source of fluid pressure, a rod within said first sleeve and having a shoulder engageable with a third snap ring of said first sleeve, said rod, first sleeve third snap ring, second sleeve outer surface and cap defining a closed chamber, whereby fluid pressure applied at said port telescopes said rod and first sleeve away with respect to said second sleeve and when said fluid pressure is terminated, said rod and first sleeve return within said second sleeve.

10. The telescoping cylinder of claim 9, wherein said rod shoulder comprises a further snap ring, said further snap ring engaging said first sleeve third snap ring and lifting said first sleeve when fluid pressure is applied at said port and said rod has reciprocated to engage said further snap ring with said first sleeve third snap ring.

11. The working member of claim 5, further including a passageway extending radially through said sleeve adjacent said fourth groove.

12. The working member of claim 1, wherein said sleeve is cylindrical.

13. The working member of claim 9, wherein said sleeves are cylindrical.

14. The working member of claim 9, further including a guide member within said rod connected between said cap and said rod and precluding relative rotation between said cap and said rod.

15. The working member of claim 14, wherein said guide member comprises a plurality of telescoping tubes of non-circular cross-section.

16. The working member of claim 15, wherein said cross-section of said telescoping tubes is rectangular.

17. A telescoping working member including a plurality of cylindrical sleeves according to claim 11, including a first sleeve having a first diameter and a second sleeve having a second larger diameter, a first cap surrounding a first end of said second sleeve and having a port connectable to a source of fluid pressure, a rod within said first sleeve and having a shoulder engageable with a fourth snap ring of said first sleeve, said rod, first sleeve fourth snap ring, second sleeve outer surface and cap defining a closed chamber, a second cap surrounding a second end of said second sleeve and having a passage connected with said passageway in said second sleeve, whereby fluid pressure applied at said port telescopes said rod and first sleeve away with respect to said second sleeve, and fluid pressure applied at said passageway returns said rod and first sleeve within said second sleeve.

18. The telescoping working member of claim 17, wherein said rod shoulder comprises a further snap ring, said further snap ring engaging said first sleeve fourth snap ring and lifting said first sleeve when fluid pressure is applied at said port and said rod has reciprocated to engage said further snap ring with said first sleeve fourth snap ring.

19. The working member of claim 1, wherein said snap rings are made of a low friction material.

20. The working member of claim 19, wherein said material comprises an acetate plastic.

21. The working member of claim 19, wherein said material comprises low friction metal.

22. A telescoping working member system comprising a plurality of cylindrical sleeves including a first sleeve having a first diameter telescoping within a second sleeve having a second larger diameter, a cap mounted over a first end of said second sleeve and having a fluid port, said first sleeve having an outer surface carrying first seal means for sealing with an inner surface of said second sleeve, said first sleeve having an inner surface sealingly engaging a rod, a sealed chamber being defined by said cap, said second sleeve, said first sleeve outer surface seal and second seal means between said rod and an inner surface of said first sleeve; and actuating means for said system comprising:

a) a source of fluid pressure;

b) a venturi having an inlet and an outlet, a throat and a throat port connected into said throat;

c) said source being connected to said inlet;

d) said throat port being connected to said cap fluid port;

e) said outlet being connected to an on-off fluid valve;

whereby when said valve is closed, fluid pressure from said source travels through said throat port and into said cap fluid port and pressurizes said sealed chamber thereby extending said rod and first sleeve with respect to said second sleeve, and whereby when said valve is opened, fluid freely flowing through said venturi induces a vacuum at said throat thereby evacuating said sealed chamber and retracting said rod and first sleeve.

23. The system of claim 22, wherein said first seal means comprises two closely spaced grooves each receiving a snap ring, a land defined between said grooves and carrying an O-ring.

24. The system of claim 23, further including two back-up rings, one of said back-up rings being located on each lateral side of said O-ring and captured on said land by said snap rings.

25. The system of claim 23, wherein said second seal means comprises an inner surface of said first sleeve having a groove, a snap ring in said groove and a seal mounted in a groove formed in an outer surface of said rod.

26. The system of claim 20, wherein said snap rings are made of a low friction material.

27. The system of claim 26, wherein said material comprises an acetate plastic.

28. The system of claim 26, wherein said material comprises low friction metal.

29. The system of claim 22, further including a guide member within said rod connected between said cap and said rod and precluding relative rotation between said cap and said rod.

30. The system of claim 29, wherein said guide member comprises a plurality of telescoping tubes of non-circular cross-section.

31. The system of claim 30, wherein said cross-section of said telescoping tubes is rectangular.

* * * * *